United States Patent [19]

Lewins

[11] Patent Number: 4,723,566

[45] Date of Patent: Feb. 9, 1988

[54] VALVE CLOSURE

[75] Inventor: John D. Lewins, South Wirral, United Kingdom

[73] Assignee: Koninklijke Emballage Industrie Van Leer B.V., Amstelveen, Netherlands

[21] Appl. No.: 803,397

[22] Filed: Dec. 2, 1985

[51] Int. Cl.[4] ..... B67D 1/04

[52] U.S. Cl. ..... 137/212; 137/320; 222/400.7

[58] Field of Search ..... 137/212, 587; 222/400.7; 137/320

[56] References Cited

U.S. PATENT DOCUMENTS

| | | | |
|---|---|---|---|
| 3,672,390 | 6/1972 | Gravesteijn | 137/212 |
| 4,529,105 | 7/1985 | Lewins | 137/212 X |
| 4,548,343 | 10/1985 | Gotch | 137/212 X |

FOREIGN PATENT DOCUMENTS 0069816 1/1983 France .

*Primary Examiner*—Alan Cohan

*Attorney, Agent, or Firm*—Brumbaugh, Graves, Donohue & Raymond

[57] ABSTRACT

Valve closure for the discharge of liquid from a container by means of pressurized gas, said valve closure comprising a housing and a channel for discharge of liquid having an end wall at its top end and liquid passage openings near said end wall, an elastic valve body disposed around said liquid discharge channel, and clamped at one of its edges, and openings (18) provided in said valve body (5) which in the unstressed closing position of the valve body are closed off by a portion (11) of said housing and which openings (18) are in communication with the inside of said container through openings (21) in said housing (2) or in a part (3) connected therewith, whereas in the deformed open position of the valve body said openings (18) are in alignment with the openings (21) in said housing and said valve body is in positive sealing engagement with a seat to prevent the liquid and gas streams from being short-circuited.

2 Claims, 2 Drawing Figures

VALVE CLOSURE

The invention relates to a valve closure for the discharge of liquid from a container by means of pressurised gas, said valve closure comprising a housing and a channel for discharge of liquid having an end wall at its top end and liquid passage openings near said end wall, an elastic valve body disposed around said liquid discharge channel, which valve body, in its unstressed closing position, closes off with respect to the outside the liquid passage through said passage openings and which valve body can be brought in an open position by an elastic deformation in which position liquid is permitted to flow through said passage openings to the outside, said valve body being capable to return by its elasticity from the open position to the closing position.

Such a valve closure is known from European Patent Application No. 81 40 1122.7 (publication number 69816). The main application for it is a beer tap, regulating the infeed of carbon dioxide and the discharge of beer from a barrel. The closure can also be used to control the infeed and discharge of washing liquid and/or steam when cleaning the beer barrel, and to fill the barrel with beer. There are essentially two types of these valve closures, a type with two concentric valve bodies, one for beer and one for carbon dioxide, and a type with a single valve body for regulating both the passage of beer and carbon dioxide. The invention is concerned with the latter type.

In the known design the elastic valve body is formed by an upstanding sleeved-shaped member which is supported at its bottom end portion by a flange-shaped part of said housing and which at its top end portion embraces said liquid discharge channel so that in the unstressed position said liquid passage openings are covered and closed-off, and in opening said passage openings the sleeve-shaped member is deformed axially in pushing downwardly said top end portion along said discharge channel in keeping said portion in sealing engagement with said discharge channel to prevent the liquid and gas streams from being short-circuited. However, said sealing engagement is subject to default.

The purpose of the invention is to produce an improved design of the type indicated in the preamble.

According to the invention, the elastic valve body is clamped at one of its edges, and openings are provided in said valve body which in the unstressed closing position of the valve body are closed off by a portion of said housing and which openings are in communication with the inside of said container through openings in said housing or in a part connected therewith, whereas in the deformed open position of the valve body said openings are in alignment with the openings in said housing and said valve body is in positive sealing engagement with a seat to prevent the liquid and gas streams from being shortcircuited.

In order to make changing of the valve body easy and to permit a relatively simple shape for the core part, the valve body can be clamped against the housing by a connecting piece of thermoplastic material which also forms the seat for the gas seal-off position, and which is provided with one or more gas passage openings which are in line with gas passage openings in a radial flange of the core part, the connecting piece resting on said radial flange.

The invention will now be explained in greater detail with reference to the drawings, in which an embodiment is shown in cross section.

Figure 1:
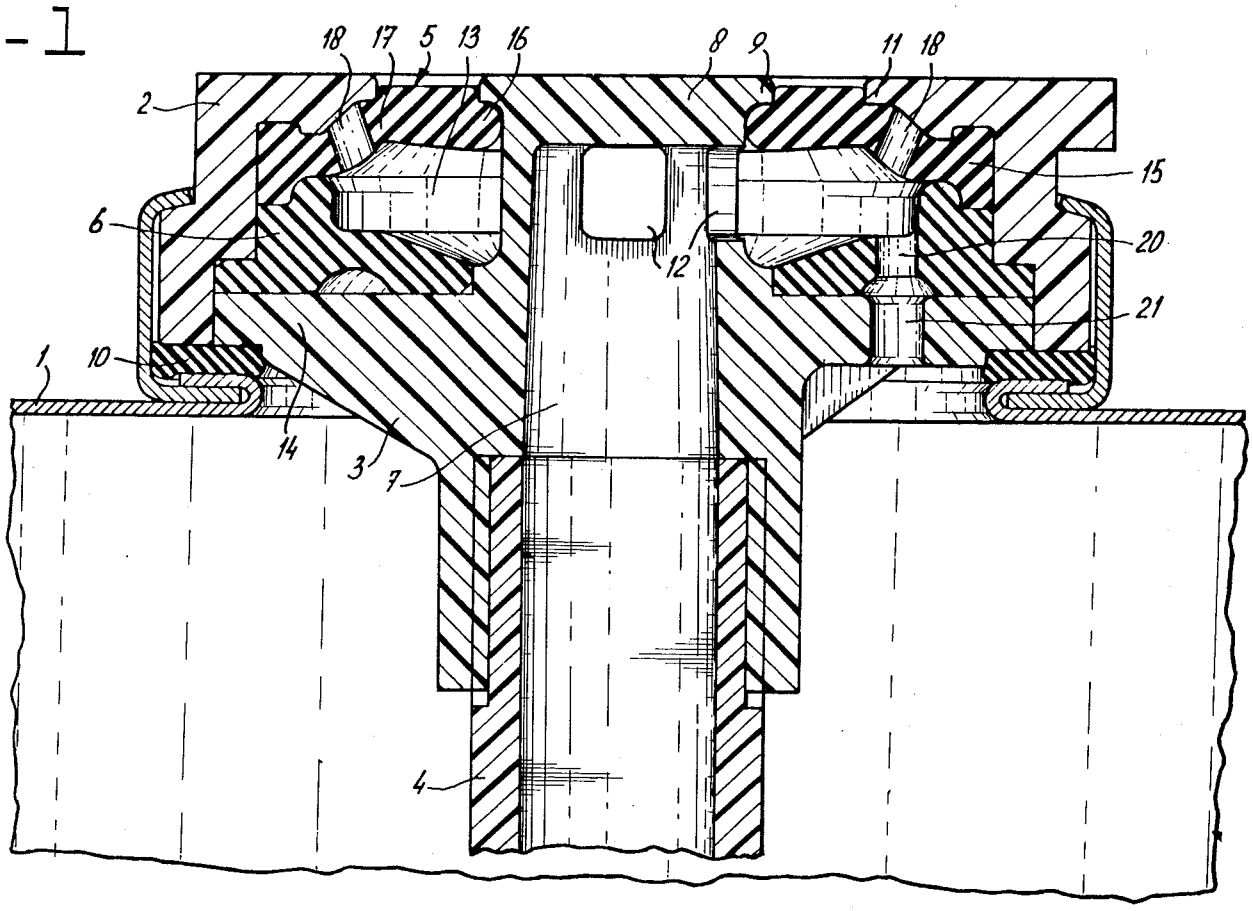
FIG. 1 shows the closed position.

The valve closure illustrated, which is fitted in the discharge opening of a beer barrel 1, comprises a housing 2, a core part 3 retained inside said housing, a liquid pipe 4 connected to said core part and projecting inside the barrel, a valve body 5 made of elastic material, and a connecting piece 6 made of thermoplastic material.

The housing 2 is fixed to a beaded edge of the barrel 1 by means of a bracket 7. Of course, other fixing methods are possible.

The core part 3 has a recess 7 which runs in line with the liquid pipe 4 and is closed off at the end by an end wall 8. Formed on that end wall is an annular flange 9 which is situated opposite an annular flange 11 of the housing 2.

The recess 7 of the core part is connected via openings 12 with a chamber 13, which in turn is connected via the annular gap between the flanges 9 and 11 with the surroundings if the valve body 5 is taken to the open position.

The connecting piece 6 rests on a flange 14 of the core part 3. Positioned between the lower edges of the housing 2 and the end of the flange 14, on the one hand, and the beaded edge of the barrel 1, on the other, is a sealing ring 10.

Figure 2:
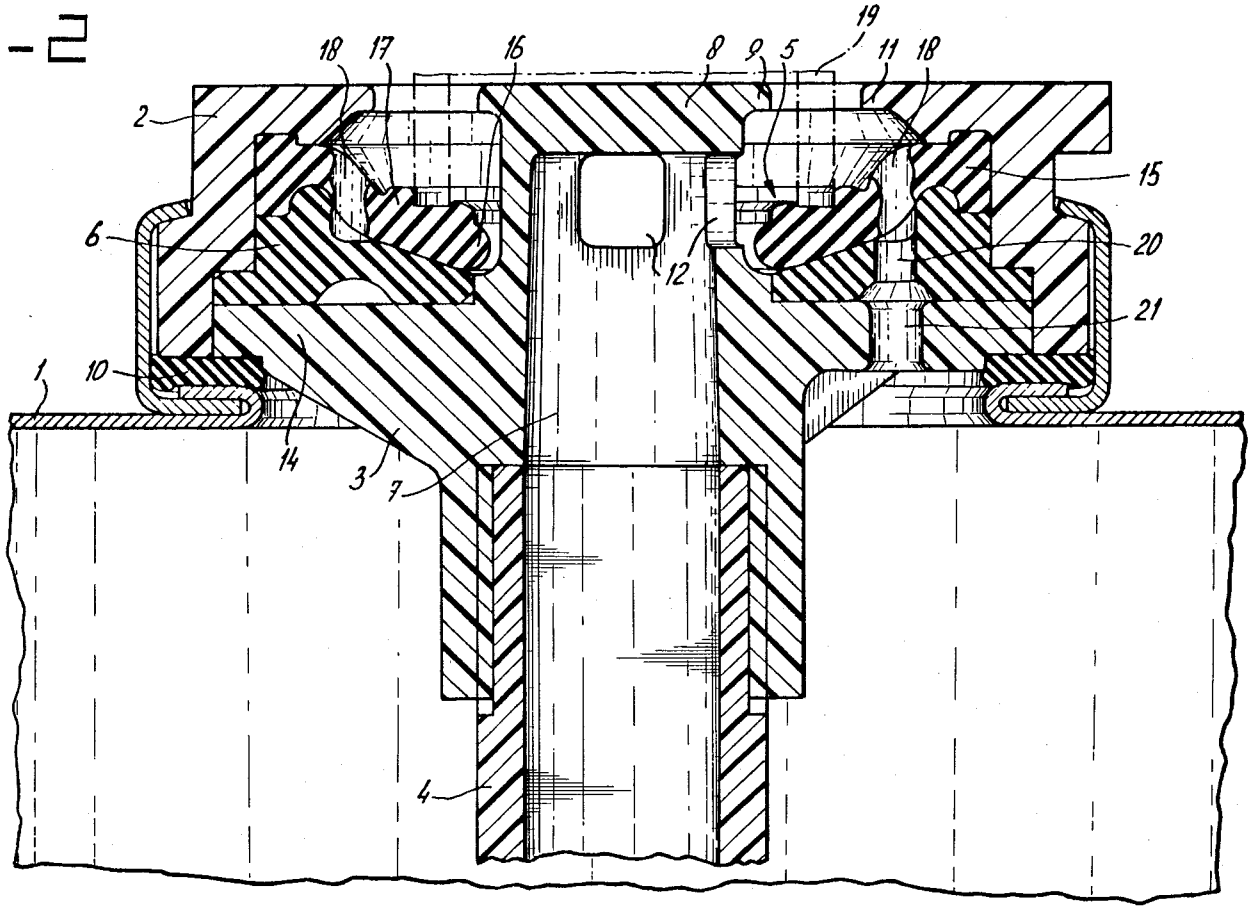
FIG. 2 shows the drawing position.

The valve body 5, which consists of one piece of elastic material, comprises a clamping flange 15, an up and down moving flange 16, and a connecting web 17 between them. Hollowed out of that connecting web 17 are one or more gas passage openings 18, which in the open position of the valve body (FIG. 2) are in line with gas passage openings 20 and 21 in the connecting piece 6 and the flange 14 of the core part respectively. The passage openings 21 open out into the barrel 1.

FIG. 1 shows the valve closure in the closed position, in which the flange 16 of the valve body lies with some pretensioning against both the radial flange 11 of the housing 2 and the radial flange 9 of the end piece 8.

In order to open the valve closure, use is made of an operating instrument which is known per se, and of which a pipe 19 gripping the flange 16 of the valve body 3 is shown. When operated, this pipe pushes the flange 16 and the web 17 of the valve body 3, with elastic deformation thereof, against the connecting piece 6, which in the manner shown fulfils a function for clamping of the flange 15 of the valve body relative to the housing 2.

The pressurised carbon dioxide fed in at the outside of the pipe 18 flows via the gap between the pipe 19 and the radial flange 11 into the chamber 13 and from there via the aligned openings 18, 20 and 21 into the barrel.

The increased pressure in the barrel causes the beer (or other liquid) to flow via the liquid pipe, the recess 7 of the core part, the openings 12, the chamber 13, the gap between the radial flange 9 and the inside surface of the pipe 19, and via this pipe 19 to the drawing point.

Through the sealing grip of the pipe 19 on the flange 16 of the valve body and said flange 16 on the connecting piece 6, the gas flow is prevented from being short-circuited without passing the barrel 1.

An essential part of the invention is that when the pipe 19 of the operating instrument is pulled back the valve body 5 returns to the closed position through its own elasticity, and without any additional spring.

The valve described is of simple design and, through the absence of a stainless steel spring, can be manufactured considerably more cheaply than known valve closures for a beer tap.

Various modifications are possible within the framework of the invention. The valve body could also be clamped on its radial inside edge relative to the core part. Nor is the shape of the valve body critical, so long as it seals off with some pretensioning in the closed position and can return by its own elasticity from the open to the closed position.

What is claimed is:

1. Valve closure for the discharge of liquid from a container by means of pressurised gas, said valve closure comprising a housing and a channel for discharge of liquid having an end wall at its top end and liquid passage openings near said end wall, an elastic valve body disposed around said liquid discharge channel, which valve body, in its unstressed closing position, closes off with respect to the outside the liquid passage through said passage openings and which valve body can be brought in an open position by an elastic deformation in which position liquid is permitted to flow through said passage openings to the outside, said valve body being capable to return by its elasticity from the open position to the closing position, characterised in, that said elastic valve body (5) is clamped at one of its edges, and openings (18) are provided in said valve body (5) which in the unstressed closing position of the valve body are closed off by a portion (11) of said housing and which openings (18) are in communication with the inside of said container through openings (21) in said housing (2) or in a part (3) connected therewith, whereas in the deformed open position of the valve body said openings (18) are in alignment with the openings (21) in said housing and said valve body is in positive sealing engagement with a seat to prevent the liquid and gas streams from being short-circuited.

2. Valve closure according to claim 1, characterised in, that a core part (3) is provided inside said housing, that said valve body(5) is clamped against said housing by a connecting piece (6) made of thermoplastic material which also forms the seat for the gas seal-off position and is provided with one or more gas passage openings (20) which are in line with gas passage openings (21) in a radial flange (14) of the core part (3), the connecting piece (6) resting on said radial flange (14).

* * * * *